US008413383B2

(12) United States Patent
Van Camp et al.

(10) Patent No.: US 8,413,383 B2
(45) Date of Patent: Apr. 9, 2013

(54) ADJUSTABLE DOOR SILL ASSEMBLY AND CARRIAGE

(75) Inventors: Brent Van Camp, Kernersville, NC (US); Andrew Krochmal, Greensboro, NC (US)

(73) Assignee: Endura Products, Inc., Colfax, NC (US)

( * ) Notice: Subject to any disclaimer, the term of this patent is extended or adjusted under 35 U.S.C. 154(b) by 133 days.

(21) Appl. No.: 12/899,929

(22) Filed: Oct. 7, 2010

(65) Prior Publication Data

US 2012/0085037 A1 Apr. 12, 2012

(51) Int. Cl.
*E06B 1/70* (2006.01)

(52) U.S. Cl.
USPC ..... 49/468; 52/126.5

(58) Field of Classification Search ..... 49/467, 49/468, 505, 469, 470, 471; 52/126.5, 211
See application file for complete search history.

(56) References Cited

U.S. PATENT DOCUMENTS

| | | | | |
|---|---|---|---|---|
| 3,402,512 | A | 9/1968 | Peterson | |
| 3,762,100 | A | 10/1973 | Kempel | |
| 3,962,828 | A * | 6/1976 | McAllister | 49/468 |
| 4,352,258 | A | 10/1982 | Bursk et al. | |
| 4,399,927 | A * | 8/1983 | Yaotani et al. | 220/789 |
| 5,136,814 | A * | 8/1992 | Headrick | 49/468 |
| 5,179,804 | A | 1/1993 | Young | |
| 5,230,181 | A * | 7/1993 | Geoffrey et al. | 49/469 |
| 5,426,894 | A | 6/1995 | Headrick | |
| 5,517,788 | A * | 5/1996 | McGough et al. | 49/468 |
| 5,611,173 | A | 3/1997 | Headrick et al. | |
| 5,638,641 | A | 6/1997 | Joffe et al. | |
| 6,125,584 | A | 10/2000 | Sanders | |
| 6,125,599 | A * | 10/2000 | Mees et al. | 52/204.5 |
| 6,185,870 | B1 * | 2/2001 | Mettler | 49/468 |
| 6,345,477 | B1 | 2/2002 | Kepler et al. | |
| 6,367,201 | B1 | 4/2002 | Massey et al. | |
| 6,484,446 | B2 | 11/2002 | Young | |
| 6,789,358 | B2 | 9/2004 | Procton et al. | |
| 7,263,808 | B2 | 9/2007 | Massey et al. | |
| 7,266,929 | B1 * | 9/2007 | Allred et al. | 52/211 |
| 7,389,611 | B2 | 6/2008 | Palenske | |
| 7,472,516 | B2 | 1/2009 | Pepper et al. | |
| 7,540,699 | B2 | 6/2009 | Selle | |
| 2002/0194787 | A1 | 12/2002 | Bennett | |
| 2004/0139667 | A1 | 7/2004 | Massey et al. | |
| 2004/0200153 | A1 * | 10/2004 | Khanlarian | 49/468 |
| 2005/0210754 | A1 | 9/2005 | Ferrell | |
| 2005/0232724 | A1 | 10/2005 | Selle | |
| 2006/0053707 | A1 * | 3/2006 | Palenske CI | 52/204.1 |
| 2006/0174545 | A1 | 8/2006 | Young | |
| 2008/0229669 | A1 | 9/2008 | Abdollahzadeh et al. | |
| 2009/0199486 | A1 | 8/2009 | Wernlund et al. | |

* cited by examiner (Continued)

FOREIGN PATENT DOCUMENTS

WO WO 01/73249 A1 10/2001

*Primary Examiner* — Katherine Mitchell
*Assistant Examiner* — Justin Rephann
(74) *Attorney, Agent, or Firm* — Womble Carlyle Sandridge & Rice, LLP

(57) ABSTRACT

An adjustable door sill assembly can include a threshold. A threshold cap can be on the threshold and have at least one opening formed therein. A carriage can be beneath the threshold cap and positioned proximate the at least one opening. At least one adjustment element on the carriage is capable of causing the threshold cap to move vertically with respect to the threshold. The adjustment element can be accessible through the opening on the threshold cap. A cap plug can cover the opening, the cap plug being removably attachable with the carriage.

28 Claims, 11 Drawing Sheets

ADJUSTABLE DOOR SILL ASSEMBLY AND CARRIAGE

FIELD OF THE INVENTION

The present invention relates generally to entry door sill constructions, and more particularly, to an adjustable door sill assembly.

BACKGROUND OF THE INVENTION

Residential entry doors are typically constructed with door threshold sill assemblies designed to seal against the weather, particularly wind and water, when the door is closed. A wide variety of door sill assemblies include adjustable threshold caps, these caps being the portion of the threshold that resides directly beneath a closed door and provides sealing contact with the bottom of the door or the door sweep. These adjustable threshold assemblies assist in creating an effective weather seal at the threshold. Adjustable caps allow an installer, or a subsequent homeowner or resident, to optimize the fit of a specific door as necessary. By adjusting the vertical clearance properly, wind and water are more effectively excluded without hampering the operation of the door.

Adjustable threshold designs attempt to balance manufacturing efficiency with the seal integrity, ease of installation and adjustability and aesthetics. Poor quality component parts and hardware variability can undermine threshold stability and sealing effectiveness. Removable parts may be improperly installed or lost prior to installation, which can also diminish sealing integrity and also result in poor appearance. Replacing non-standard hardware components may be expensive, and parts may not be readily available for shipment. Adjustment mechanisms used on aluminum threshold caps, for example, may not be used on wood threshold caps, which in turn, makes materials' management more complex when dealing both with wood cap based door sills and non-wood cap based door sills.

Thus, there is a need for an adjustable threshold assembly that improves threshold assembly stability, and facilitates efficient manufacture and installation.

SUMMARY OF THE INVENTION

The following presents a simplified summary of the invention in order to provide a basic understanding of some aspects of the invention. This summary is not an extensive overview of the invention and is not intended to identify key or critical elements of the invention or to delineate the scope of the invention. The purpose of this section is to present some concepts of the invention in a simplified form as a prelude to the more detailed description that is presented later.

An adjustable door sill assembly can include a threshold. A threshold cap can be on the threshold and have at least one opening formed therein. A carriage can be beneath the threshold cap and positioned proximate the at least one opening. At least one adjustment element on the carriage is capable of causing the threshold cap to move vertically with respect to the threshold. The adjustment element can be accessible through the opening on the threshold cap. A cap plug can cover the opening, the cap plug being removably attachable with the carriage.

DETAILED DESCRIPTION

Figure 1:
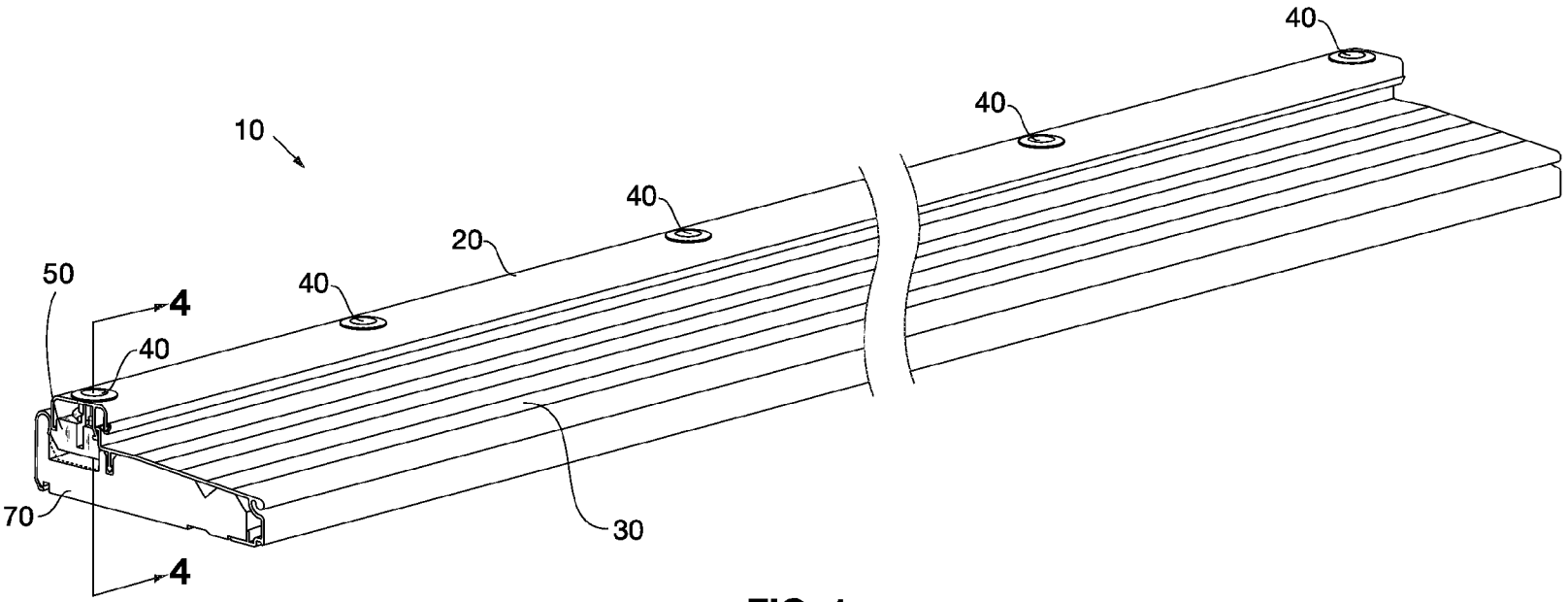
FIG. 1 is a front perspective view of an adjustable door sill assembly.

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

According to common practice, the various features of the drawings discussed below are not necessarily drawn to scale. Dimensions of various features and elements in the drawings may be expanded or reduced to more clearly illustrate the embodiments of the invention.

FIGS. 1, 2 and 3A and 3B show an adjustable door sill assembly 10 according to one embodiment of the invention. The door sill assembly 10 includes a substrate 70 defining an upwardly open channel 88, a sill deck or cover 30, and a vertically adjustable threshold cap 20 in the channel 88 with a plurality of openings 23 being spaced along the length of the cap. A threshold as used herein can refer to a substrate and deck. Cap plugs 40 cover the openings 23 and are removably secured to a carriage 50 positioned proximate the openings 23 beneath the threshold cap 20. A neck portion of the cap plug 40 passes through the opening 23 and engages the carriage 50 resting within the channel 88 and atop the substrate 70. An adjustment element 80 adjustably disposed within carriage 50 rests atop the substrate 70. An installer, resident, or homeowner can remove cap plug 40 from the carriage 50 and access the adjustment element 80. The adjustment element 80 can be rotated to cause adjustment of the carriage 50 and thus the threshold cap 20 between a raised position elevated above the substrate 70 and a lowered position 50*a* (illustrated in dashed lines in FIG. 2).

With the cap plug 40 engaged with carriage 50, as opposed to the cap plug being retained by the threshold cap 20, environmental fluctuations can have less of an impact on threshold sealing integrity. One reason for this is that the thermal expansion/contraction characteristics between the cap plug and carriage may not differ as much as the thermal expansion/contraction characteristics between the cap plug and cap may differ. For example, an aluminum cap and plastic cap plugs may not expand and contract at the same rate, which can result in gaps for water intrusion. Further, precise machining of the cap openings and cap plugs is not as necessary to ensure a seal when the cap plug is attached to the carriage as opposed to the threshold cap 20.

The adjustable door sill assembly shown in FIGS. 1-6E can include a threshold cap 20 formed from plastic, aluminum, metal, composite or other material that can be formed into a complex strong structure. Wood caps, however, typically are thicker and occupy more volume in the door sill assembly than metal or plastic caps. This is due in part to the inability of wood to be machined with thin walls that are strong that also include intricate or complex details, sharp turns, or the precise openings needed for the adjustment mechanisms. An alternate embodiment of an adjustable door sill assembly and carriage that can be used with wood threshold caps is shown in FIGS. 7-11E, and will be described in more detail below. The cap plug, carriage, and cap of the assembly 10 can be made of similar materials, as needed. For example, the cap plug can be any formed plastic material. The carriage 50 can also be any machinable, moldable, or extrudable material such as, for example, plastic, composites, and the like. The substrate 70 can be any material, including, but not limited to, wood, composite, polymeric or other rigid material. The deck or cover 30 can also be any material, such as aluminum or plastic as needed.

Figure 2:
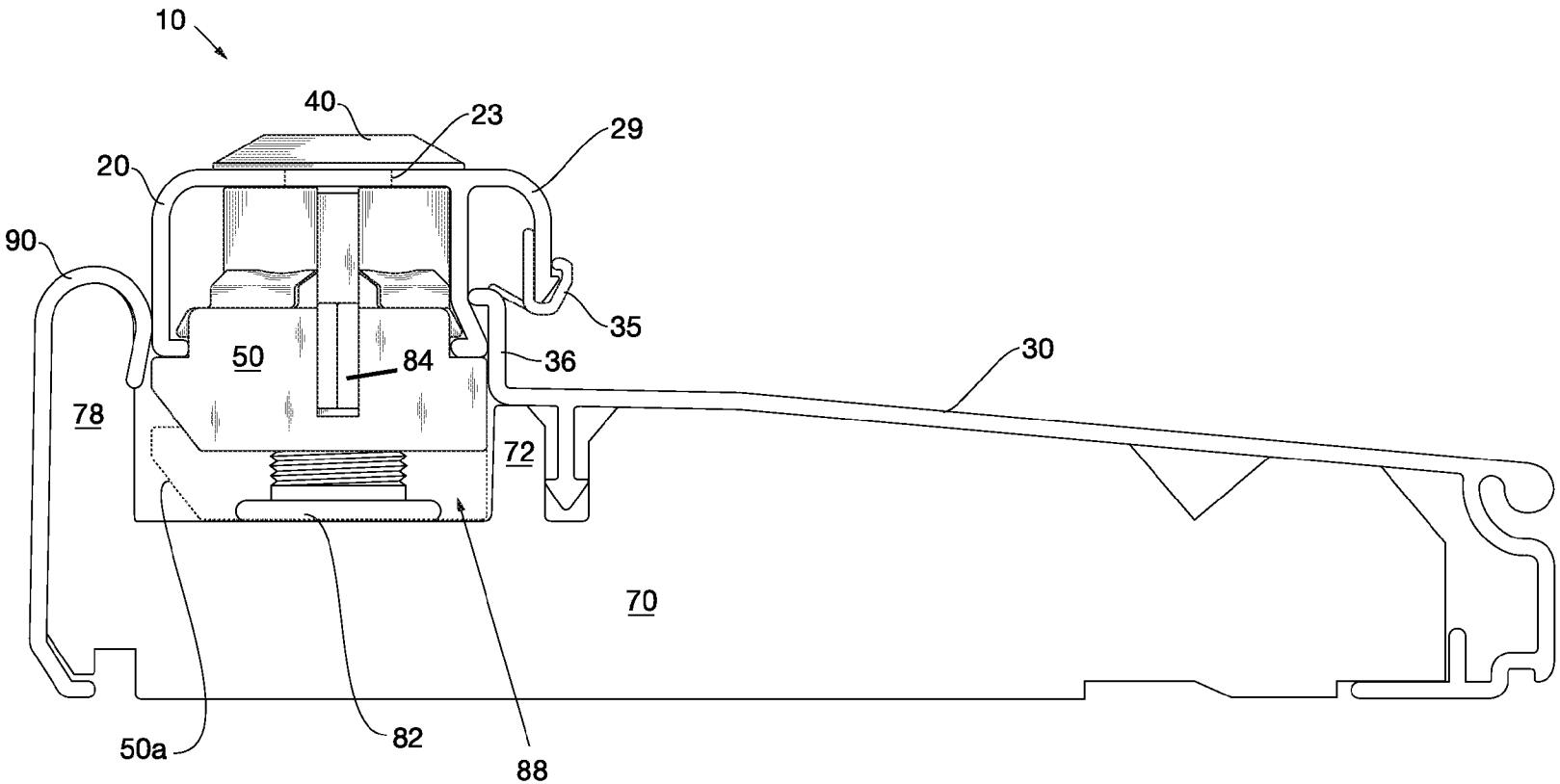
FIG. 2 is an end view of the adjustable door sill assembly shown in FIG. 1.
Figure 3A:
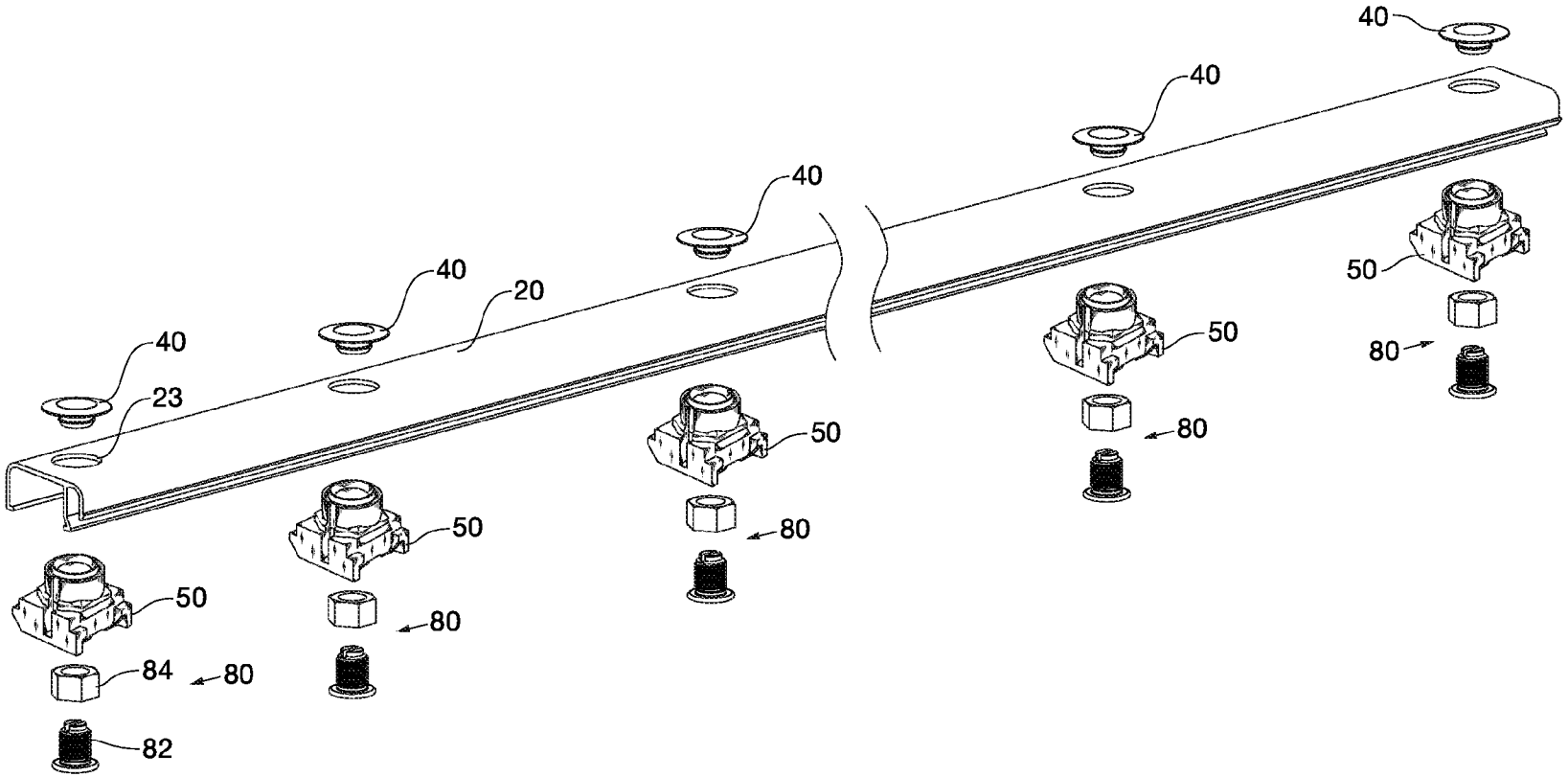
FIG. 3A is a front perspective exploded view of a threshold cap and carriage assemblies.
Figure 3B:
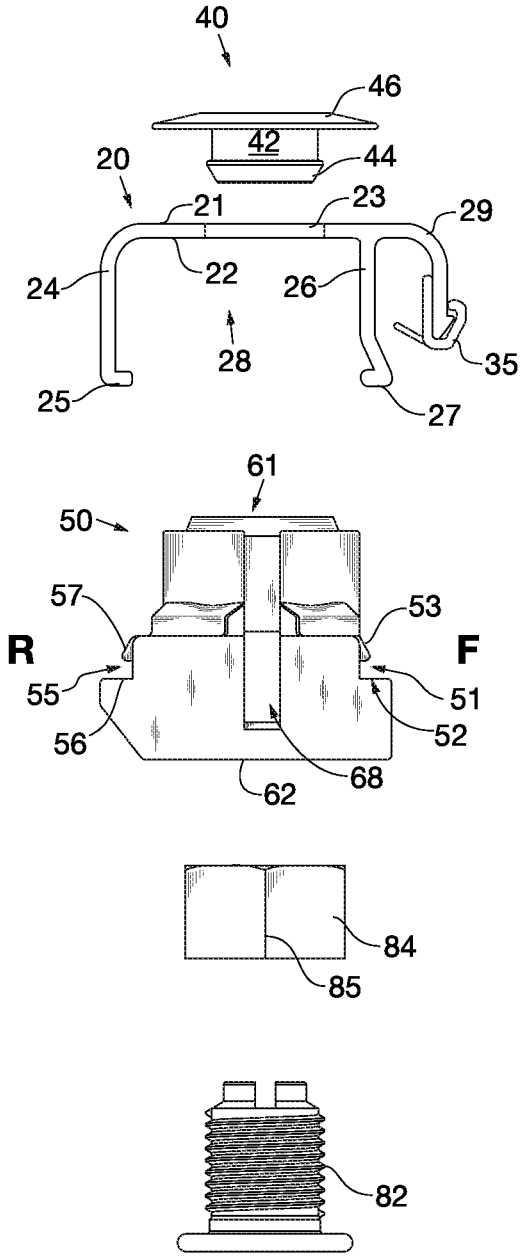
FIG. 3B is an end exploded view of a threshold cap and carriage.

In one embodiment, the adjustable door sill assembly 10 can have one or more seals such as cap seal 35 illustrated in FIG. 3B. As shown in FIG. 2, a nosing portion 78 and a forward wall 72 extend up from the substrate 70 to define the upwardly open channel 88 that can receive the carriage 50. The spacing between the nosing 78 and wall 72 can be sized to permit vertical translation of the carriage 50 therein. A nosing cover 90 fits over the nosing portion 78 and extends around the top thereof to contact and rest against threshold cap 20. Nosing cover 90 and threshold cap 20 can form a seal along their line of contact to limit the intrusion of water into the sill 10, and may limit the escape of air through the entryway in which the sill assembly 10 is installed. As shown in FIGS. 1 and 2, a front seal can be formed between the threshold cap 20 and cover 30. The cover 30 includes a wall or dam 36 that projects upwardly and engages the cap 20 and a cap seal 35. The cap seal 35 can be affixed to leg 29 and can form a seal between the leg 29 and the dam 36 to inhibit water from being blown up and over the dam into the channel 88.

Turning to FIG. 3A, one or more carriages 50 and adjustment elements 80 may be assembled with the threshold cap 20. In one embodiment, a carriage 50 is selectively positionable along the length of the threshold cap so that each carriage can be located beneath a corresponding opening 23. In another embodiment, a threshold cap 20 may have a length that is shorter than the length of the threshold assembly. In such an embodiment, the shortened threshold cap (not shown), carriage, and adjustment elements, preferably can be selectively positioned along any portion of the adjustable door sill assembly 10 whether or not the cap resides there.

FIGS. 3B, 4A, 4B and 4C show how cap plug 40, threshold cap 20, carriage 50 and adjustment elements 82 and 84 cooperate within the adjustable door sill assembly 10. The cap plug 40 can include a protrusion 42 that extends from a cap plug top 46. The protrusion 42 includes a shoulder 44 thereon. The cap plug protrusion 42 can be received or snapped within the carriage 50 and removably fixed therein, as will be further described below.

Threshold cap openings 23 can extend between the upper and lower surfaces 21 and 22 of threshold cap 20. In an embodiment, the opening 23 can have a shape sized large enough to allow the cap plug protrusion 42 and shoulder 44 to pass therethough, but small enough to cause the cap plug top 46 to rest on the upper surface 21 of the threshold cap 20.

Figure 4A:
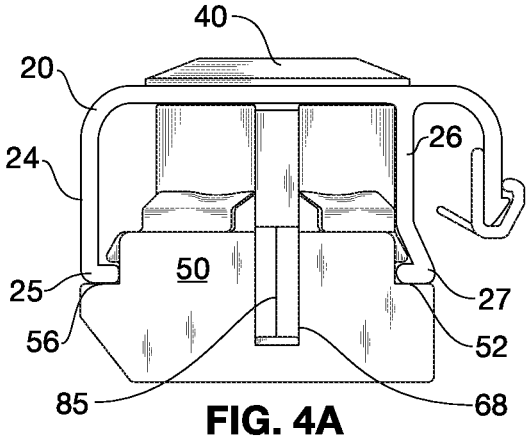
FIG. 4A is an end view of a threshold cap and carriage assembly.
Figure 4B:
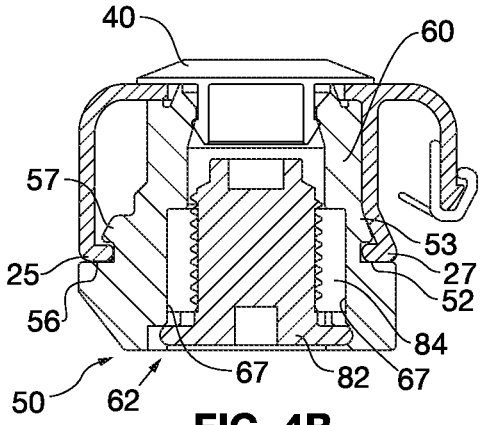
FIG. 4B is a cross-section of a threshold cap and carriage assembly taken along lines 4-4 in FIG. 1.
Figure 4C:
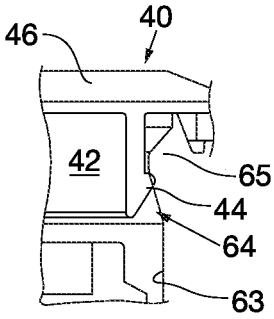
FIG. 4C is a detailed view of a portion of the cross-sectional view in FIG. 4B, showing the internal profile of the carriage.
Figure 5A:
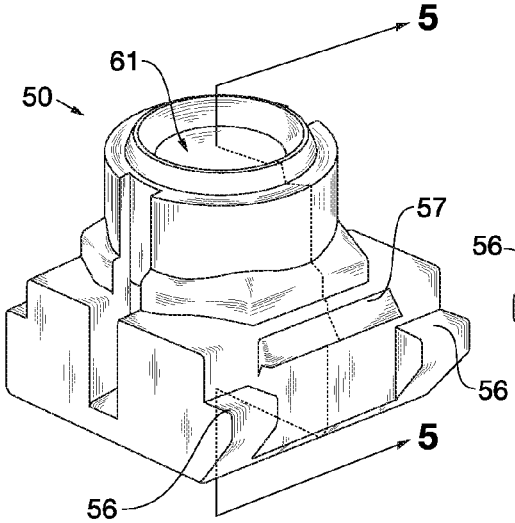
FIGS. 5A through 5C are rear, front, and bottom perspective views of a carriage, respectively.
Figure 5B:
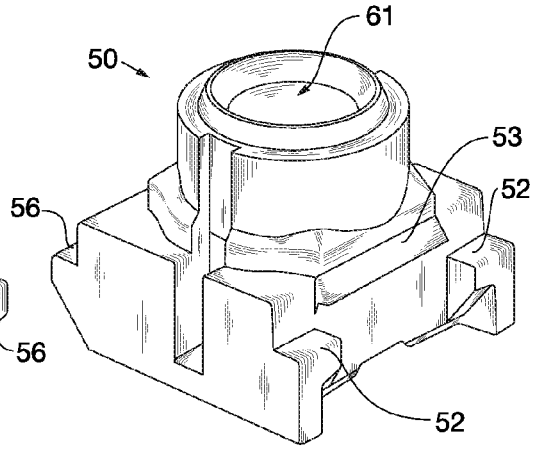
Figure 5C:
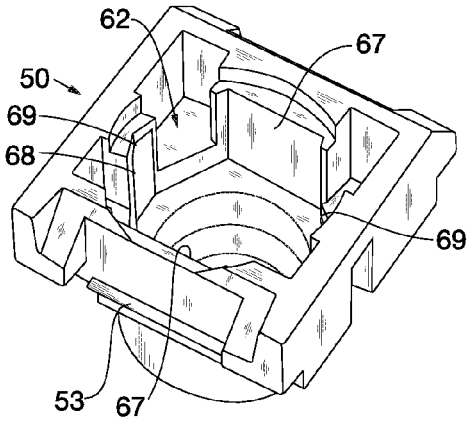
Figure 5D:
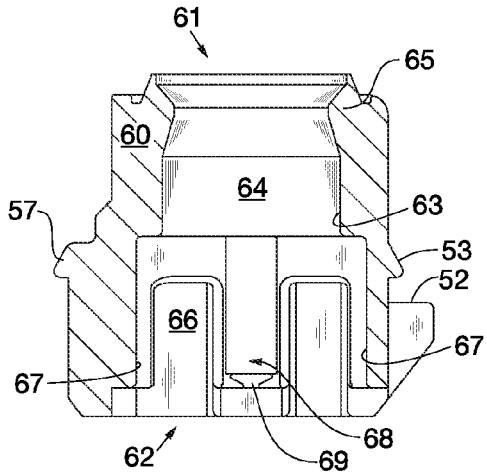
FIG. 5D is a cross-section of a carriage taken along lines 5-5 in FIG. 5A.

FIGS. 4A through 4C and 5D illustrate how the cap plug 40 can pass through the opening 23 and be removably attached to the carriage 50. As shown in FIG. 5D, the carriage 50 includes a housing 60 comprising an upper opening 61 for receiving the cap plug 40, and a lower opening 62 for receiving the adjustment element 80 therein. The opening 61 extends through the housing 60 so that when the cap plug 40 is removed, a user can access the adjustment element 80 as needed with an adjustment tool such as a screwdriver.

Continuing with FIGS. 4B, 4C, and 5D, the housing 60 can include an upper, cap plug receiving portion 64, and a lower, adjustment element receiving portion 66. The cap plug receiving portion 64 can include a projection 65 extending from the housing wall 63 that releasably retains the cap plug shoulder 42. In one embodiment, the projection 65 extends circumferentially around the wall 63 of the cap plug receiving portion 64. In other embodiments, the projection 65 may extend circumferentially around a portion of the inner wall 63. In other alternate embodiments, the cap plug receiving portion 64 can have any number or type of projections that can interact with and retain the cap plug. For example, the projections may be a plurality of separate ridges extending from the housing wall 63. In the embodiment shown, the receiving portion 64 of the wall 63 can have a shape corresponding to a hyperbolic cylinder. In other embodiments, the receiving portion 64 can have a projection proximate the opening 61 to form a truncated conical shape.

As shown in FIGS. 4A, 4B, 5C, 5D, and 6E, the lower receiving portion 66 of the carriage 50 can be configured to receive an adjustment element 80. The walls 67, lips 69, and slotted openings 68 cooperate to snap-fit the adjustment element 80 in the carriage 50. The wall segments 67 can form a profile that is similar to the outer profile of the adjustment element 80. Two lips 69 are shown on opposing sides of the lower portion 66 of the carriage 50. Two slotted openings 68 (shown in FIGS. 3B, 5D and 6C) extend through the housing 60 to the adjustment element receiving portion 66. The opening 68 can be located above the lips 69 also on opposing sides of the carriage 50.

In an embodiment, the adjustment element 80 can include a threaded bolt 82 and hexagonal nut 84 having corners 85. As the nut 84 is placed in the opening 62 and aligns with the lower portion 66, two opposing corners 85 of the nut engage lips 69 slightly pushing the lips 69 apart. As the nut 84 is received in the lower portion 66, the corners 85 extend pass the lips 69 and partially enter the slotted openings 68. FIG. 4A shows the corner 85 of the nut 84 in the slotted opening 68.

The hexagonal adjustment nut 84 can fit within the adjustment element receiving portion 66 in contact with wall segments 67. When an installer or user needs to adjust the height of the threshold cap 20, the cap plug 40 can be removed and the top portion of the bolt 82, which is slotted, is exposed. Rotation of the bolt 82 with a screwdriver or similar tool causes the nut 84 to advance vertically along the axis of the bolt 82 and thereby elevate the carriage 50 to a desired position. Since the threshold cap rests on the carriages, the threshold cap is adjusted along with the carriages. In alternate embodiments, the lower portion 66 can be designed to receive an adjustment bolt directly. For example, the walls 67 may form a threaded opening through which an adjustment bolt can be threaded.

As shown in FIGS. 2, 3B, 4A and 4B, the threshold cap 20 can be configured to snap-fit with the carriage 50. The threshold cap 20 can have a first leg 24 and a second leg 26 forming a channel 28 to receive a portion of the outer surface of the carriage 50. At the distal ends of the first and second legs 24 and 26 are lips 25 and 27, respectively. The first and second legs 24 and 26 can engage the outer surfaces of the carriage 50 for a tight, stable fit, as will be further described below. A third leg 29 extends from the threshold cap and has a cap seal 35 secured thereto, which can form a seal with the dam 36 of the cover 30. In the embodiment shown in FIGS. 2 and 4A, the legs 24 and 26 can extend toward but do not reach the substrate 70. Further, the threshold cap 20 can include in one embodiment a single horizontal wall having openings 23 therein. Because the carriage includes an adjustment element 80 therein, no additional horizontal wall on the threshold cap 20 is needed to retain the adjustment element.

Figure 6A:
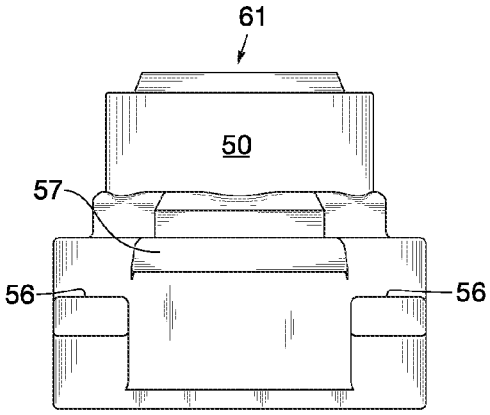
FIGS. 6A through 6E are rear, front, side, top and bottom views of a carriage, respectively.

As shown in FIGS. 3B, 5A, 5B, 5D and 6A-6C, the carriage 50 has an outer surface that cooperates with threshold cap 20 to provide a stable snap-fit. As shown in FIG. 3B, the rear (R) refers to the side of the carriage 50 and threshold cap 20 facing the inside of the building. The front (F) refers to the side of carriage 50 and threshold cap 20 facing the outside of the building. The carriage 50 includes one or more rear ledges 56 and rear ridge 57 that form a gap 55 to receive lip 25 of the threshold cap leg 24. A similar gap 51 is formed on the front of the carriage 50 and is described below. The bottom surface of the ridge 57 can be positioned a distance above and substantially parallel to the upper surface of the ledges 56. As shown in FIGS. 5A, 6A and 6D, the bottom surface of the ridge 57 may not overlap ledges 56. In other embodiments, the ridge 57 and ledges 56 can overlap. In alternate embodiments, rear ledges 56 and ridge 57 can be any member, or set of members, arranged to form a gap for receiving a threshold cap leg.

Figure 6B:
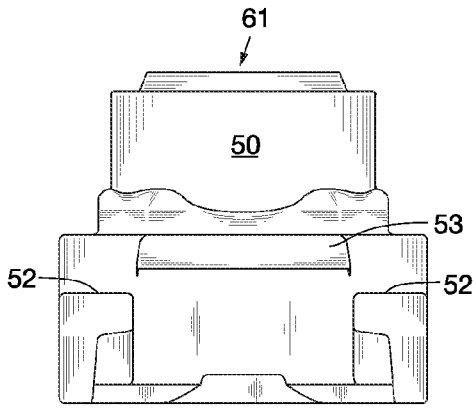

As shown in FIGS. 3B, 5A, 5B, 5D, 6B and 6C, the carriage 50 also includes front ledges 52, ridge 53 and gap 51 formed therebetween. The front ridge 53 also has a bottom surface positioned a distance above the upper surfaces of the front ledges 52. In one embodiment, the bottom surface of the ridge 53 can be parallel to the upper surface of the ledges 52. As shown in FIGS. 5A, 5B and 6B, the bottom surface of the ridge 53, however, may not overlap the upper surface of the ledges 52. In alternate embodiments, the front ledges 52 and ridge 53 can be any member, or set of members, arranged to form a gap for receiving a threshold cap leg.

Figure 6C:
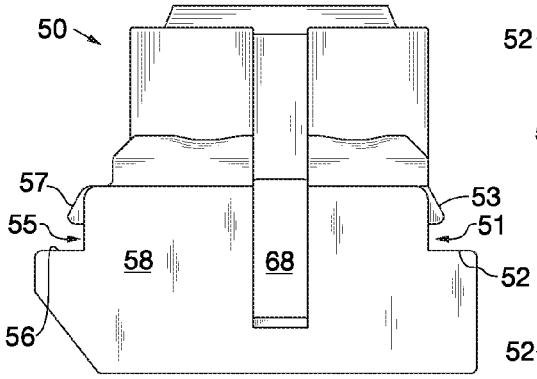
Figure 6D:
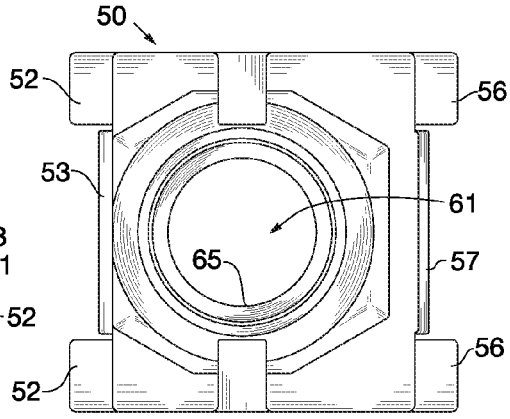
Figure 6E:
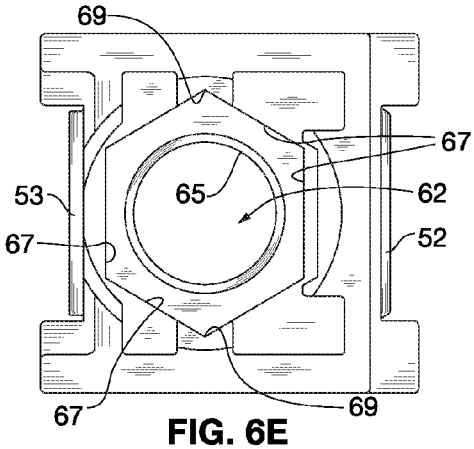
Figure 7:
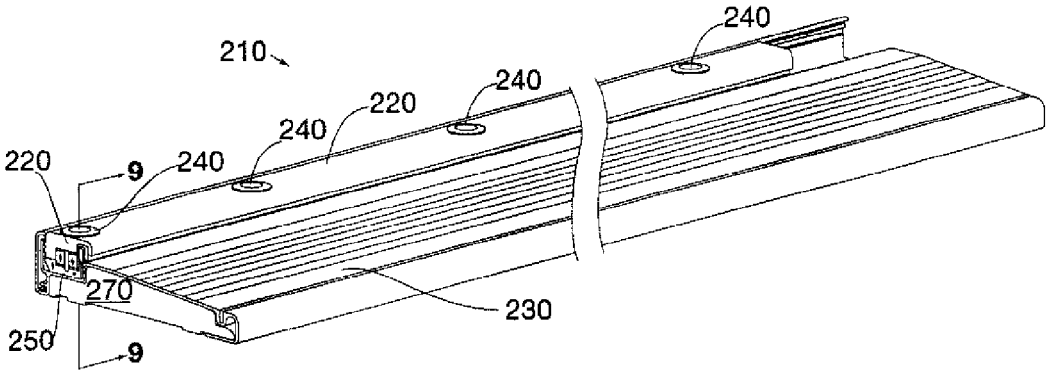
FIG. 7 is a front perspective view of another embodiment of an adjustable threshold sill assembly.

As shown in FIGS. 3B and 6C, the upper portion of the ridges 53 and 57 can slope outward from the carriage toward gap 51 and 55, respectively. When the carriage 50 is placed within the threshold cap 20, the sloped ridges permit threshold cap legs (24 and 26) to glide along and over the ridges 57 and 53 and snap-fit within the gap 55 and 51, respectively.

Another embodiment of an adjustable threshold assembly is shown in FIGS. 7-11E that includes a wood-based threshold cap 220. The door sill assembly 210 includes a substrate 270, sill deck or covet 230 forming an upwardly open channel 238, and a vertically adjustable threshold cap 220 in the channel 238 with a plurality of openings 223 (not shown) being spaced along the length of the cap. Cap plugs 240 cover the openings 223 and are removably secured to the carriage 250 positioned proximate the openings 223 beneath the cap 220. A neck portion of the cap plug 240 passes through the opening 223 and engages with the carriage 250 resting within the channel 238 of the cover 230. An adjustment element 280 (not shown) is adjustably disposed within carriage 250 and rests atop the cover 230 and substrate 270. The threshold cap 220 includes a retention strip 290 with a cap seal 235 secured thereto, as will be further described below. The cap plug 240 engaging the carriage 250, as opposed to the cap 220 can result in improved stability as described above with respect to carriage 50.

Figure 8:
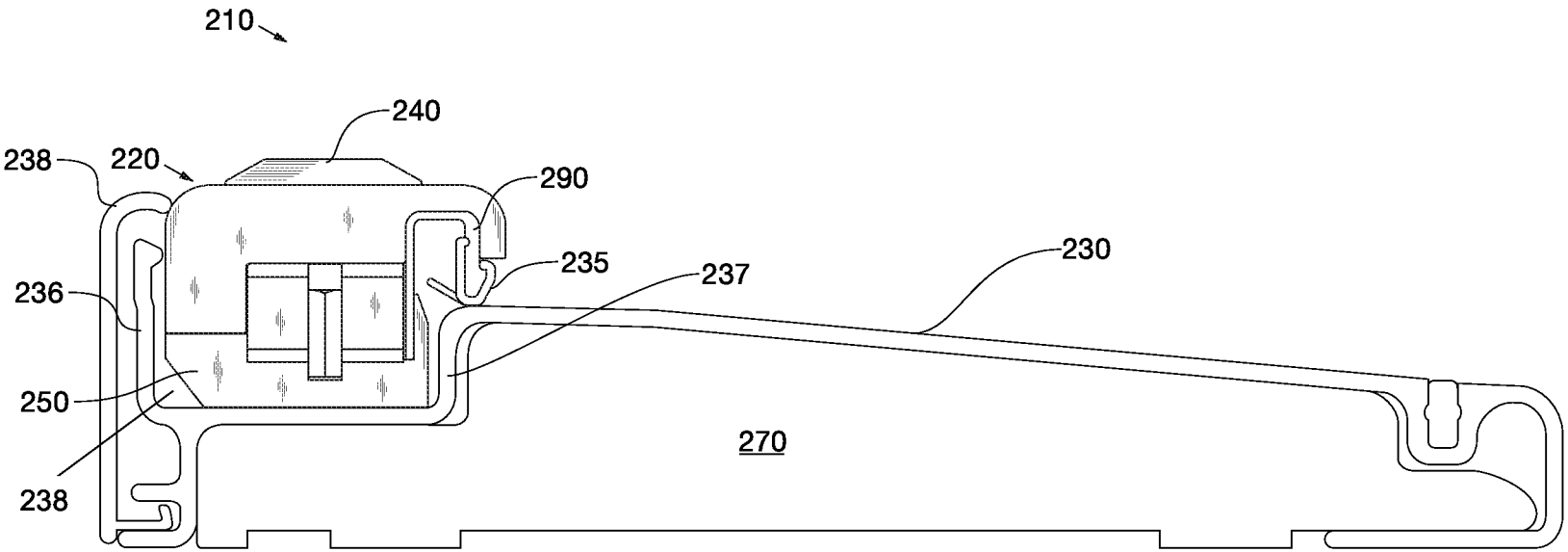
FIG. 8 is an end view of another embodiment of an adjustable door sill assembly.

Continuing with FIG. 8, the cover 230 extends over the substrate 270 and forms a channel 238 between upwardly extending rear wall 236 and front wall 237 that receives a carriage 250. The spacing between the rear wall 236 and wall 237 can be sized to permit vertical translation of the carriage 250 therein. In other embodiments, the cover 230 may cover a portion of the substrate 270 such that carriage 250 rests on the substrate between a channel formed in the substrate as described above.

Figure 10:
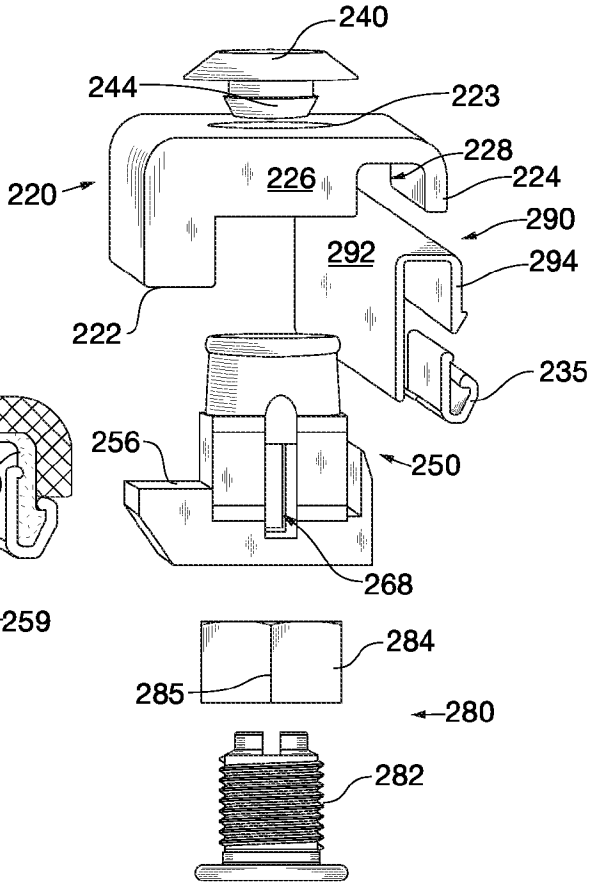
FIG. 10 is a side perspective exploded view of another embodiment of a threshold cap and carriage.

The door sill assembly 210 can include one or more seals, such as the cap seal 235 illustrated in FIGS. 8 and 10. A cap seal 235 is attached to a retention strip 290 and forms a seal between the cap 220 and cover 230. The adjustable door sill assembly 210 includes a nosing 238 that engages the cover 230 and threshold cap 220. The lower portion of the nosing 238 engages the cover 230. The upper portion of the nosing 238 forms a seal with the threshold cap 220 that can limit the intrusion of water into the door sill 210, and may limit the escape of air through the entryway in which the sill 210 is installed. In other embodiments, the nosing can be integrally formed with the substrate, and include a nosing cover that engages the cap 220, similar to the embodiment described above.

One or more carriages 250 may be assembled with the threshold cap 220. In one embodiment, a carriage 250 is selectively positionable along the length of the threshold cap 220 so that each carriage can be located beneath a corresponding opening 223. In other embodiments, a threshold cap 220 may have a length that is shorter than the length of the threshold assembly. In such an embodiment, the shortened threshold cap (not shown), carriage and adjustment elements, preferably can be selectively positioned along any portion of the adjustable door sill assembly 210 whether or not a cap resides there.

Figure 9B:
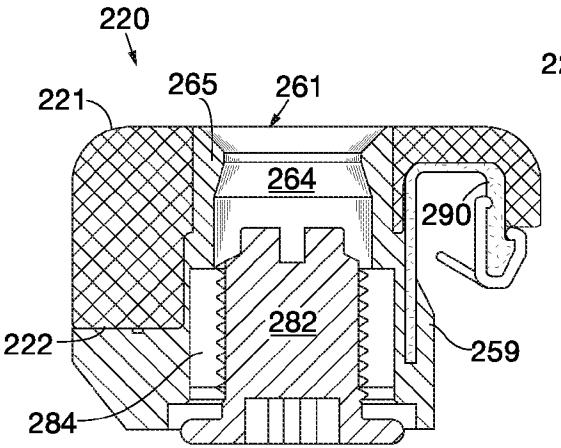
FIG. 9B is a cross-section of another embodiment of a threshold cap and carriage taken along lines 9-9 in FIG. 7.
Figure 9A:
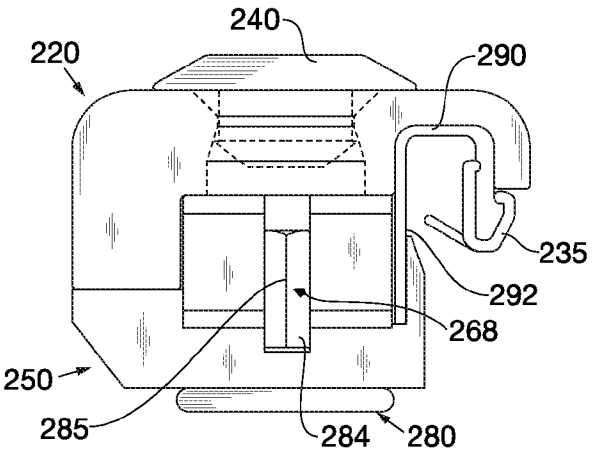
FIG. 9A is an end view of another embodiment of a threshold cap and carriage assembly.

FIGS. 9A-10 show how the cap plug 240, threshold cap 220, carriage 250, retention strip 290 and adjustment elements 280 cooperate within the adjustable door sill assembly 210. The cap plug 240 is similar to the embodiment described above, and includes a top 246, protrusion 242, and shoulder 244. The cap plug protrusion 242 can pass through the openings 223 and be removably attached within the carriage 250, while the top 246 can rest on the threshold cap upper surface 221 (shown in FIG. 8).

One or more threshold cap openings 223 extend through the threshold cap 220. In an embodiment, the openings 223 can have a shape sized large enough so that the cap plug protrusion 242 and shoulder 244 can pass therethrough, but small enough so that cap head 246 rests on the upper surface 221 of the threshold cap 220. The openings 223 can have any shape, e.g., circular, oval, etc., as needed.

FIGS. 9A, 9B, 10 and 11E, illustrate how the cap plug 240 can pass through the opening 223 and be removably attached to the carriage 250. The carriage 250 includes a housing 260 comprising an upper, opening 261 for receiving the cap plug 240, and a lower opening 262 for receiving the adjustment element 80 therein, as will be further described below. The opening 261 extends through the carriage 250 so that when the cap plug 240 is removed, a user can access the adjustment element 280 as needed with an adjustment tool such as a screw driver.

Figure 11A:
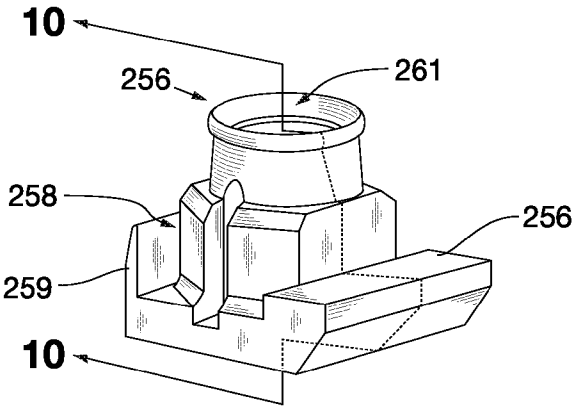
FIGS. 11A through 11D are front perspective, side, top, and bottom views of another embodiment of the carriage, respectively.
Figure 11B:
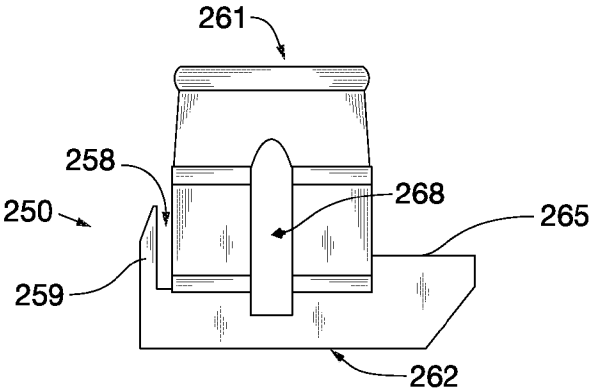
Figure 11C:
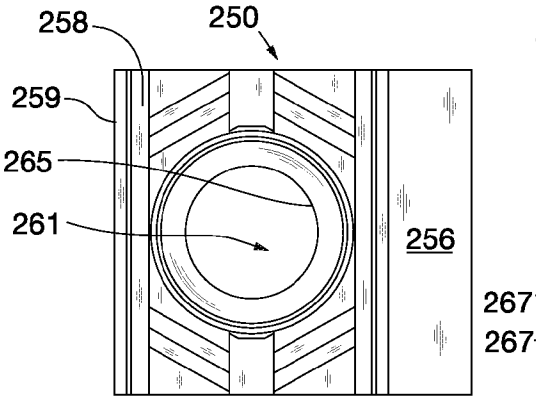
Figure 11D:
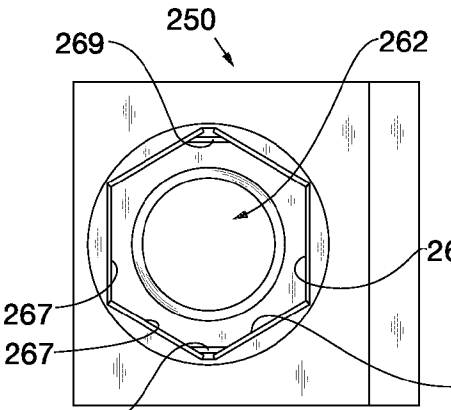
Figure 11E:
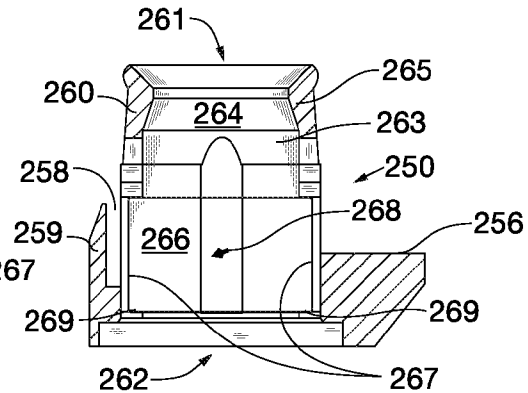
FIG. 11E is a cross-section of the carriage taken along the lines 11-11 in FIG. 11A.

As shown in FIGS. 9B and 11E, the housing 260 can include a cap plug receiving portion 264, and a lower, adjustment element receiving portion 266, respectively. The cap plug receiving portion 264 can include a projection 265 extending from the housing wall 263 that releasably retains the shoulder 242 of the cap plug 240. In one embodiment, the projection 265 extends circumferentially around the wall 263 of the receiving portion 264. In other embodiments the projection 265 may extend circumferentially around a portion of the wall 263. In alternate embodiments, the receiving portion 264 can have any number or type of projections that can interact with and retain the cap plug therein. For example, the projections may be a plurality of separate ridges extending from the housing wall 263. In the embodiment shown, the receiving portion 264 of the wall 263 can have a shape corresponding to a hyperbolic cylinder. In other embodiments, the receiving portion 264 can have a projection proximate opening 261 to form a truncated conical shape.

As shown in FIGS. 11D and 11E, the adjustment element receiving portion 266 can be configured to receive an adjustment element 280. Lower portion 266 is similar to lower portion 66 of carriage 50 described above. In an embodiment, the walls 267, lips 269, and slotted openings 268 cooperate to snap-fit the adjustment element 280 in the carriage 250. The wall segments 267 can form a profile that is similar to the outer profile of the adjustment element 280. The wall segments 267 may, however, have any profile similar to the particular nut used in the adjustment element 280. In the embodiment shown in FIG. 11D, a hexagonal adjustment nut 284 can fit within the lower receiving portion 266 in contact with wall segments 267. Two lips 269 are shown on opposing sides of the adjustment element portion 266 of the carriage 260. Two slotted openings 268 (shown in FIGS. 9A, 10, and 11B) extend through the housing 260 to the lower portion 266. The slotted openings 268 can be located above the lips 269 also on opposing sides of the carriage 250.

In an embodiment, the adjustment element 280 can include a threaded bolt 282 and hexagonal nut 284 having corners 285. As the nut 284 is placed in the opening 262 and aligns with the lower portion 266, two opposing corners 285 of the nut 284 engage lips 269 slightly pushing the lips 269 apart. As the nut 284 is received in the lower portion 266, the corners 285 extend past the lips 269 and partially enter the slotted openings 268. FIG. 9A shows the corner 285 of the nut 284 in the slotted opening 268. When an installer or user needs to adjust the height of the threshold cap 220, the cap plug 240 can be removed so that the top portion of the bolt 282, which is slotted, is exposed. Rotation of the bolt 282 with screw driver or similar tool causes the nut 284 to advance vertically along the axis of the bolt 282 and thereby elevates carriage 250 and threshold cap 220 to a desired position. Because the threshold cap rests on the carriage, the threshold cap is adjusted along with the carriages. In alternate embodiments, the lower portion 266 can be designed to receive an adjustment bolt 282 directly. For example, the wall segments 267 may form a threaded opening through which an adjustment bolt can be threaded.

As shown in FIGS. 9A-11B, and 11E, the carriage 250 has various surface features for receiving the threshold cap 220 and engagement strip 290. The carriage 250 includes a wall 259 spaced from the housing 260 to form a receiving channel 258 for the retention strip 290. A rear ledge 256 extends from the housing 260 opposite the receiving channel 258 to receive the lower surface 222 of the threshold cap 220. A leg 224 extends from the threshold cap body 226 to form a channel 228. An engagement strip 290 is positioned in the channel 228 such that leg 292 is received by carriage channel 258, while the second leg 294 engages a cap seal 235, as discussed above. In an embodiment, the carriage 250 and strip 290 can be press fit threshold cap 220. In other embodiments, adhesives can be used.

The components of the door sill assembly 210 shown in FIGS. 7-11E used with the wood cap 220 can include a variety of materials. For example, the cap plug and carriage can be made of similar materials, as described above. The substrate 70 can be any material, including, but not limited to, wood, composite, polymeric or other rigid material. The deck or cover 30 can be any material, such as aluminum, other metallic alloys, or plastic. The engagement strip 290 can be any moldable or extricable material, such as, for example, plastic, rubber compound, or metallic material. The substrate can be any material, including, but not limited to, wood, composite, polymeric or other rigid material.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

We claim:

1. An adjustable door sill assembly comprising:
a threshold; and
a threshold cap on the threshold and having at least one opening formed therein;
a carriage beneath the threshold cap and positioned proximate the at least one opening;
at least one adjustment element on the carriage capable of causing the threshold cap to move vertically with respect to the threshold, the adjustment element being accessible through the at least one opening on the threshold cap; and
a cap plug for covering the at least one opening, the cap plug being removably directly attachable with the carriage.

2. The adjustable door sill assembly of claim 1, wherein the cap plug has a protrusion with a shoulder thereon, and the carriage has a receiving portion with a projection, whereby the shoulder and the projection cooperate to removably attach the cap plug to the carriage.

3. The adjustable door sill assembly of claim 2, wherein the projection is positioned circumferentially around the receiving portion of the carriage.

4. The adjustable door sill assembly of claim 1, wherein the carriage has a means for retaining the cap plug therein.

5. The adjustable door sill assembly of claim 1, wherein the threshold cap further comprises a channel formed by at least two legs extending downwardly from the threshold cap, the carriage being snap-fit within the channel.

6. The adjustable door sill assembly of claim 1, wherein the threshold cap has a plurality of openings, the carriage is selectively positionable under any one of the plurality of openings.

7. The adjustable door sill assembly of claim 1, wherein the threshold cap has a length shorter than the length of the adjustable door sill assembly, the threshold cap and the carriage are selectively positionable along the adjustable door sill assembly.

8. A carriage, for use with a threshold cap having a first length and a cap openings, a sill, and a cap plug, the carriage comprising:

a housing positionable under the threshold cap and on top at least a portion of the sill;

the housing having a carriage opening alignable with the cap opening to directly receive and retain the cap plug; and the housing being operably connected to the threshold cap such that the threshold cap is vertically adjustable, wherein the housing has a second length that is less than the first length of the threshold cap.

9. The carriage of claim 8, wherein the housing further comprises a receiving portion with a projection extending into the carriage opening, the projection operably engaging the cap plug to allow the cap plug to be removably attached with the housing.

10. The carriage of claim 9, wherein the projection is positioned circumferentially around the receiving portion of the housing.

11. The carriage of claim 8, wherein the housing comprises one or more projections proximate the carriage opening, the one or more projections operably engaging the cap plug to allow the cap plug to be removably attached with the housing.

12. The carriage of claim 8, the carriage opening having a means for retaining a cap plug therein.

13. The carriage of claim 8, wherein the carriage opening extends through the housing, the carriage opening capable of receiving an adjustable element therein opposite the cap plug, the carriage opening providing access to the adjustment element when the cap plug is not in the opening.

14. The carriage of claim 8, wherein the carriage opening has a lower portion, the lower portion capable of matingly receiving the adjustment element.

15. The carriage of claim 14, wherein the lower portion is capable of fixably and removably receiving the adjustment element.

16. An adjustable door sill assembly capable of being adjusted to form a seal with the bottom of the door, the adjustable door sill assembly comprising:

a threshold;

a threshold cap on the threshold and having at least one opening;

a carriage beneath the threshold cap and positioned proximate the at least one opening and connected to the threshold cap;

at least one adjustment element on the carriage capable of causing the threshold cap to move vertically with respect to the threshold, the adjustment element being accessible through the at least one opening on the threshold cap; and a cap plug for covering the at least one opening, the carriage comprising a means for directly retaining the cap plug in the carriage.

17. The adjustable door sill assembly of claim 16, wherein the cap plug has a protrusion with a shoulder thereon, and the carriage has a receiving portion with a projection, whereby the shoulder and the projection cooperate to removably attach the cap plug to the carriage.

18. The adjustable door sill assembly of claim 16, wherein the threshold cap further comprises a channel formed by at least two legs extending downwardly from a top of the threshold cap, the carriage being retained within the channel.

19. The adjustable door sill assembly of claim 16, wherein threshold cap has a plurality of openings, the carriage is selectively positionable under any one of the plurality of openings.

20. The adjustable door sill assembly of claim 16, wherein the threshold cap has a length shorter than the length of the adjustable door sill assembly, the threshold cap and the carriage are selectively positionable along the adjustable door sill assembly.

21. The adjustable door sill assembly of claim 17, wherein the projection is positioned circumferentially around the receiving portion of the housing.

22. A door sill assembly comprising;

a. a threshold having a deck;

b. a channel extending along the threshold;

c. a threshold cap disposed in the channel and having an opening formed therethrough;

d. a carriage disposed beneath the threshold cap aligned with the opening; and e. a plug having a head sized to cover the opening and a protrusion sized and configured to extend through the opening and directly releasably attach to the carriage.

23. The door sill assembly of claim 22, wherein the protrusion has a shoulder thereon, and the carriage has a receiving portion with a projection, whereby the shoulder and the projection cooperate to removably attach the plug to the carriage.

24. The door sill assembly of claim 23, wherein the projection is positioned circumferentially around the receiving portion of the carriage.

25. The door sill assembly of claim 22, wherein the carriage has a means for retaining the cap plug therein.

26. The door sill assembly of claim 22, wherein the threshold cap further comprises a channel formed by at least two legs extending downwardly from a top of the threshold cap, the carriage being snap-fit within the channel.

27. The door sill assembly of claim 22, wherein the threshold cap has a plurality of openings, the carriage is selectively positionable under any one of the plurality of openings.

28. The door sill assembly of claim 22, wherein the threshold cap has a length shorter than the length of the door sill assembly, the threshold cap and the carriage are selectively positionable along the door sill assembly.

* * * * *